US006748772B2

(12) United States Patent
Lee et al.

(10) Patent No.: US 6,748,772 B2
(45) Date of Patent: Jun. 15, 2004

(54) WASHING/DRYING MACHINE AND CLOTHES DRYER

(75) Inventors: Won Hee Lee, Seoul (KR); Yoon Jei Hwang, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/043,205

(22) Filed: Jan. 14, 2002

(65) Prior Publication Data

US 2003/0056393 A1 Mar. 27, 2003

(30) Foreign Application Priority Data

Sep. 25, 2001 (KR) ..... 2001-59347

(51) Int. Cl.[7] ..... D06F 25/00

(52) U.S. Cl. ..... 68/18 C; 68/19.2; 68/20; 68/23.6; 34/77; 34/132

(58) Field of Search ..... 68/18 C, 19.2, 68/20, 23.6; 34/77, 130, 132, 595, 596

(56) References Cited

U.S. PATENT DOCUMENTS

| | | | | | |
|---|---|---|---|---|---|
| 4,154,003 | A | * | 5/1979 | Muller | 34/469 |
| 4,471,537 | A | * | 9/1984 | Meda | 34/77 |
| 4,603,489 | A | * | 8/1986 | Goldberg | 34/77 |
| 4,621,438 | A | * | 11/1986 | Lanciaux | 34/77 |
| 5,029,458 | A | * | 7/1991 | Obata et al. | 68/19.2 |
| 6,434,857 | B1 | * | 8/2002 | Anderson et al. | 34/595 |
| 6,530,245 | B1 | * | 3/2003 | Kawabata et al. | 68/20 |
| 2001/0015082 | A1 | * | 8/2001 | Minayoshi et al. | 68/19.2 |

* cited by examiner

*Primary Examiner*—Frankie L. Stinson
*Assistant Examiner*—Joseph L. Perrin
(74) *Attorney, Agent, or Firm*—Birch, Stewart, Kolasch & Birch, LLP

(57) ABSTRACT

A washing and drying machine and a clothes dryer including an air circulating duct for circulating air into the inner tub for washing or drying inputted clothes. An inner portion of a drum and an evaporator of the refrigerating cycle, may be positioned in the air circulating duct to dehumidify the circulated air to improve the efficiency of the dehumidifcation process of the circulated air, to reduce the required time for drying clothes and to reduce energy consumption.

9 Claims, 5 Drawing Sheets

WASHING/DRYING MACHINE AND CLOTHES DRYER

BACKGROUND OF THE INVENTION

1. Field of the Invention

The present invention relates to a washing and drying machine and a clothes dryer and particularly, to a washing and drying machine and a clothes dryer capable of removing moisture contained in air circulated to dry clothes.

2. Description of the Background Art

Generally, a clothes dryer is an instrument for drying washing material by supplying heated air to the washing material which was washed and dewatered by a washing machine and the like. This type of clothes dryer includes a drum positioned in a case rotatably, for accommodating clothes inside, a driving motor for rotating the drum, an air circulating duct for supplying and circulating heated air into the drum and a heater and blower which are positioned in the air circulative duct.

Recently, a washing and drying machine having a function of a dryer in a washing machine is devised. The conventional washing and drying machine will be described with reference to FIGS. 1 and 2. FIG. 1 is a longitudinal sectional view showing a conventional clothes washing and drying machine and FIG. 2 is a schematic view showing a flowing structure of air in the washing and drying machine of FIG. 1.

With reference to FIG. 2, the conventional washing and drying machine includes a case 110 having a receiving space inside, an outer tub installed in the case 110, for storing washing water inside, an inner tub 121 installed in the outer tub 111 rotatably, for accommodating clothes which will be washed, dewatered and dried and a pulsator 123 positioned on the inner bottom surface of the inner tub 121 rotatably, for forming a flow of washing water.

The washing and drying machine further includes a driving motor 113 installed on the bottom surface of the outer tub 111, for rotating and driving the inner tub 121 and pulsator 123, a power transmission device installed among the driving motor 113, inner tub 121 and the pulsator 123, for transmitting a rotation force of the driving motor 113 and performing clutching operation simultaneously, a drain hose connected on the bottom surface of the outer tub 111, for discharging washing water and a drain valve 117 installed in the drain hose installed in the drain hose 115, for opening and closing the drain hose 115.

The washing and drying machine further includes an air hose 125 extending from the lower side to the upper side in the case 110, for supplying heated air into the inner tub 121, a heater 127 positioned in the air hose 125, for heating air and a blower 129 positioned in the air hose 125, for compulsorily flowing air to add a drying function to such composition of the washing machine.

The operation of the conventional washing and drying machine with the above composition will be described as follows. When clothes are washed and dewatered, washing water is filled in the outer tub 111 and then washing and dewatering are performed rotating the pulsator 123 and the inner tub 121. To dry clothes which were washed and dewatered, the heater 127 and the blower 129 are operated. At this time, as shown in FIG. 2, air heated in the heater 127 is supplied into the inner tub 121 through the air hose 125.

The heated air supplied into the inner tub 121 dries wet clothes being contacted with the dewatered clothes and then is discharged to the outside of the case 110 through the drain hose 115.

The present inventors have determined that the background art suffers from the following disadvantages. Since the conventional washing and drying machine supplies air around the outer tub 111 into the inner portion of the inner tub 121 after heating the air by the heater 127 without an additional dehumidifying process, a heating means such as heater 127 or burner (not shown) with a relatively larger capacity is required to have a sufficient drying performance and since time for drying is lengthened in case humidity of the air is high, consumption of electricity and gas is increased, thus to increase energy consumption.

Accordingly, the present inventors have determined that clothes dryers which partly dehumidify the air by mixing air with a relatively low temperature flown from the outside and air contacted with clothes and discharged, with high temperature and humidify, heats the dehumidified air and supplies the dehumidified air into the inner tub have been devised. However, the conventional clothes dryers cannot perform dehumidifying performance well and accordingly, time for drying cannot be sufficiently shortened.

SUMMARY OF THE INVENTION

Therefore, the present invention provides a washing and drying machine and a clothes dryer capable of drying clothes by heating under the condition that the air is dehumidified using a refrigerating cycle, thus to reduce time for drying clothes and energy consumption.

To achieve these and other advantages and in accordance with the purpose of the present invention, as embodied and broadly described herein, there is provided a.

The inner tub is positioned rotatably centering around a rotation shaft positioned in the vertical direction of the case and the case, outer tub and inner tub respectively have an opened upper surface. A closing means for closing the inner portion is installed at the opened upper portion of the outer tub.

The air circulating duct is diverged from the drain hose and a valve means for switching the opening and closing direction and flowing direction is installed at the position where the drain hose and the air circulative duct are diverged. The valve means can perform a first operation for blocking the drain hose and air circulating duct not to discharge washing water, a second operation for closing the air circulating duct side and opening the drain hose side to discharge the washing water and a third operation for closing the drain hose side and opening the air circulating duct side to circulate air.

The dehumidification device is positioned at the front side of the heater in the air flowing direction. The blower, dehumidification device and the heater are consecutively installed in the air flowing direction in the air circulating duct.

A water pipe is connected to the lower portion of the air circulating duct to discharge dehumidified water.

The dehumidification device includes a compressor, a condenser, a capillary tub and an evaporator which form the refrigerating cycle circuit and the evaporator is installed in the air circulating duct and a water cooling apparatus is further included to cool water by the water cooling method.

The water cooling apparatus is composed of a cooling water tank installed at the center portion of the drain hose, for storing washing water discharged from the outer tub and cooling the condenser. A part of the refrigerant line for connecting the evaporator and condenser is cooled passing through the refrigerant line.

A water level control device for maintaining a certain water level is installed in the water cooling tank. The water level control device includes an open/close valve is installed in the drain hose connected to the lower side of the cooling water tank and an overflow tube connected to the upper portion of the cooling water tank.

To achieve the above object, a clothes dryer includes a drum positioned in a case, in which clothes are dried, an upper cover and lower cover which are fixed in the case and combined to both sides of the drum, for supporting the drum to rotate, a driving motor installed at the lower cover, for rotating the drum, an air circulating duct connected from the lower cover to the upper cove, in which air for drying the clothes inputted into the drum is circulated, a blower installed in the air circulating duct, for compulsorily circulating air, a heating device installed in the air circulating duct, for heating the circulating air and a dehumidification device for humidifying air circulated into the air circulating duct.

The drum is positioned rotatably centering around a rotation shaft positioned in the vertical direction of the case and the case, outer tub and inner tub respectively have an opened upper surface. A closing device for closing the inner portion at the opened portion of the upper cover.

The dehumidification device is positioned at the front side of the heater in the air flowing direction and the blower, dehumidification device and the heater are consecutively installed in the air flowing direction in the air circulating duct.

A water pipe for discharging water dehumidified is connected to the lower end portion of the air circulating duct.

The dehumidification device comprises a compressor, a condenser, a capillary tub and an evaporator which compose a refrigerating cycle circuit and the evaporator is installed in the air circulating duct.

A cooling water tank capable of storing a certain amount of cooling water to cool the condenser by the water cooling method is further included and the water cooling apparatus has a cooling water tank for storing a certain amount of cooling water.

The a water supply hose and drain hose are respectively connected to the cooling water tank and a drain pipe for discharging dehumidified water to the cooling water tank is connected to the lower end portion of the air circulating duct.

A water level control device for maintaining a certain water level is installed in the cooling water tank.

The foregoing and other, features, aspects and advantages of the present invention will become more apparent from the following detailed description when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE PREFERRED EMBODIMENTS

Reference will now be made in detail to the preferred embodiments of the present invention, examples of which are illustrated in the accompanying drawings.

An embodiment of the present invention is applied to a washing and drying machine which performs washing and drying functions simultaneously and the other embodiment is applied to a dryer having a drying function only.

Figure 1:
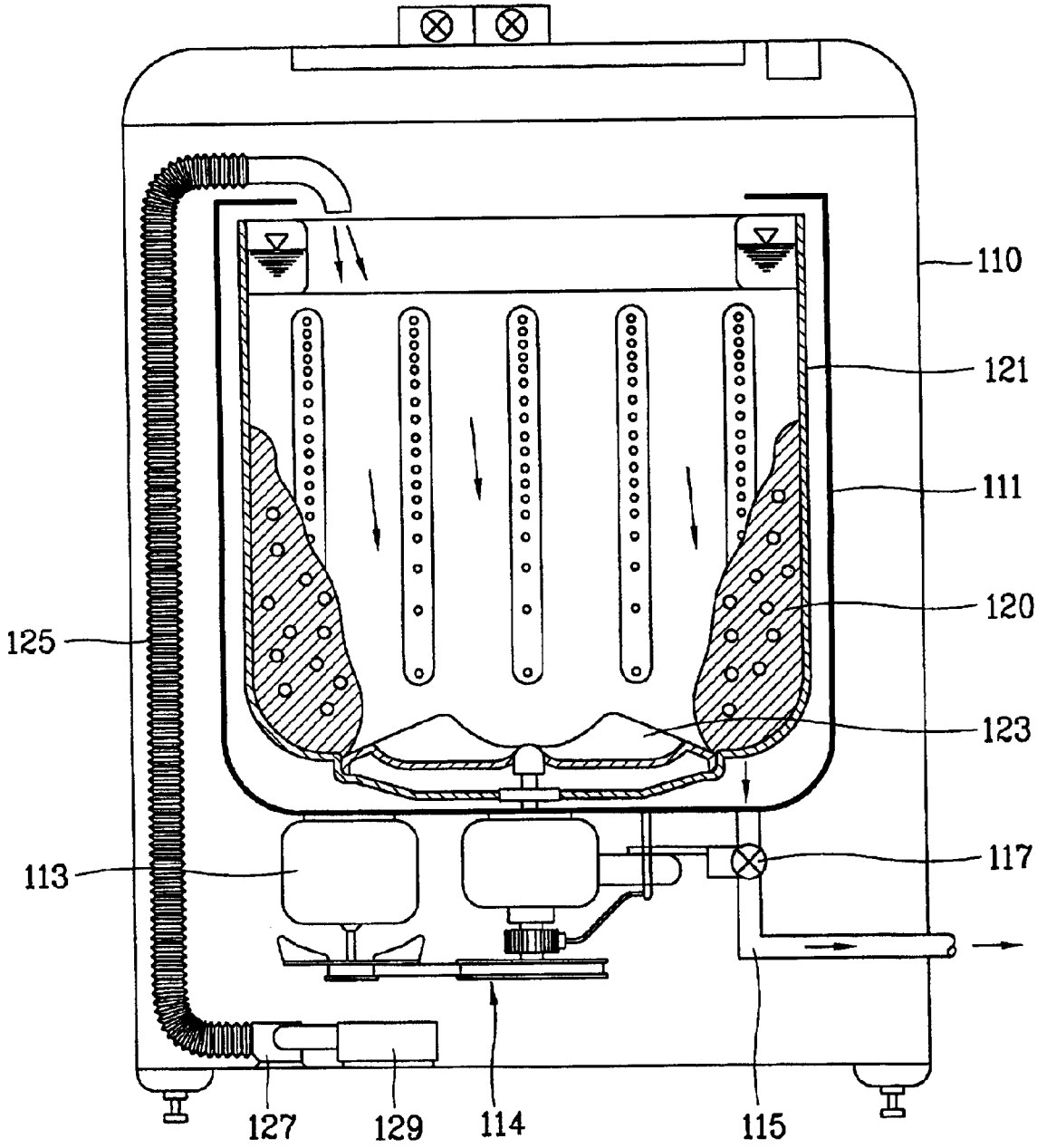
FIG. 1 BACKGROUND ART
FIG. 1 is a longitudinal sectional view showing a conventional clothes washing and drying machine.
Figure 2:
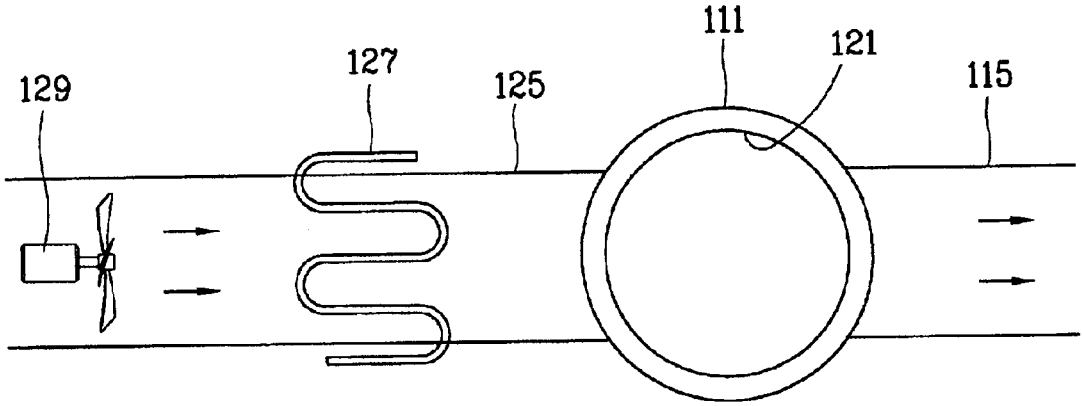
FIG. 2 BACKGROUND ART
FIG. 2 is a schematic view showing a flowing structure of air in the washing and drying machine of FIG. 1.
Figure 3:
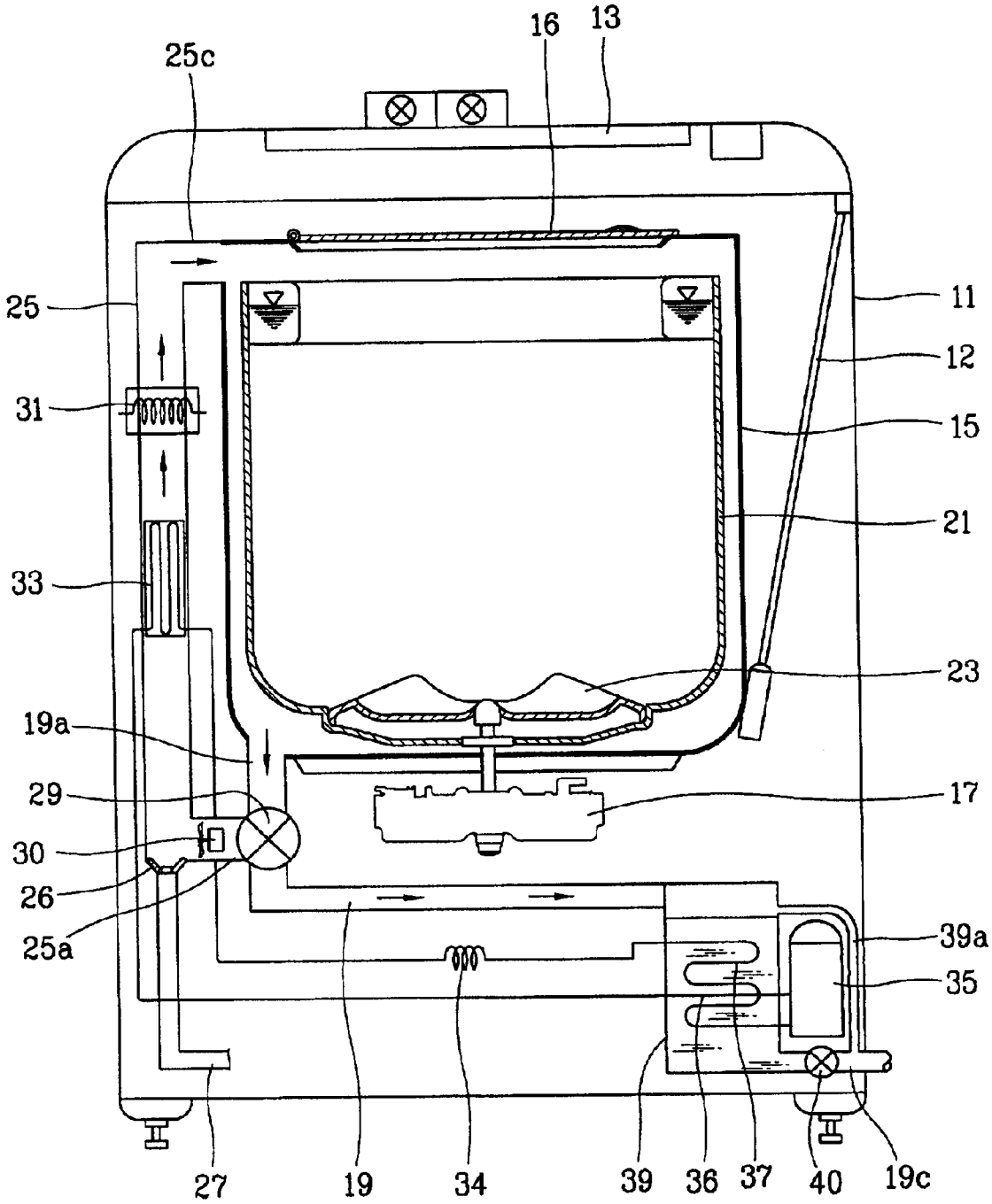
FIG. 3 is a longitudinal sectional view showing a clothes washing and drying machine in accordance with an embodiment of the present invention.
Figure 4:
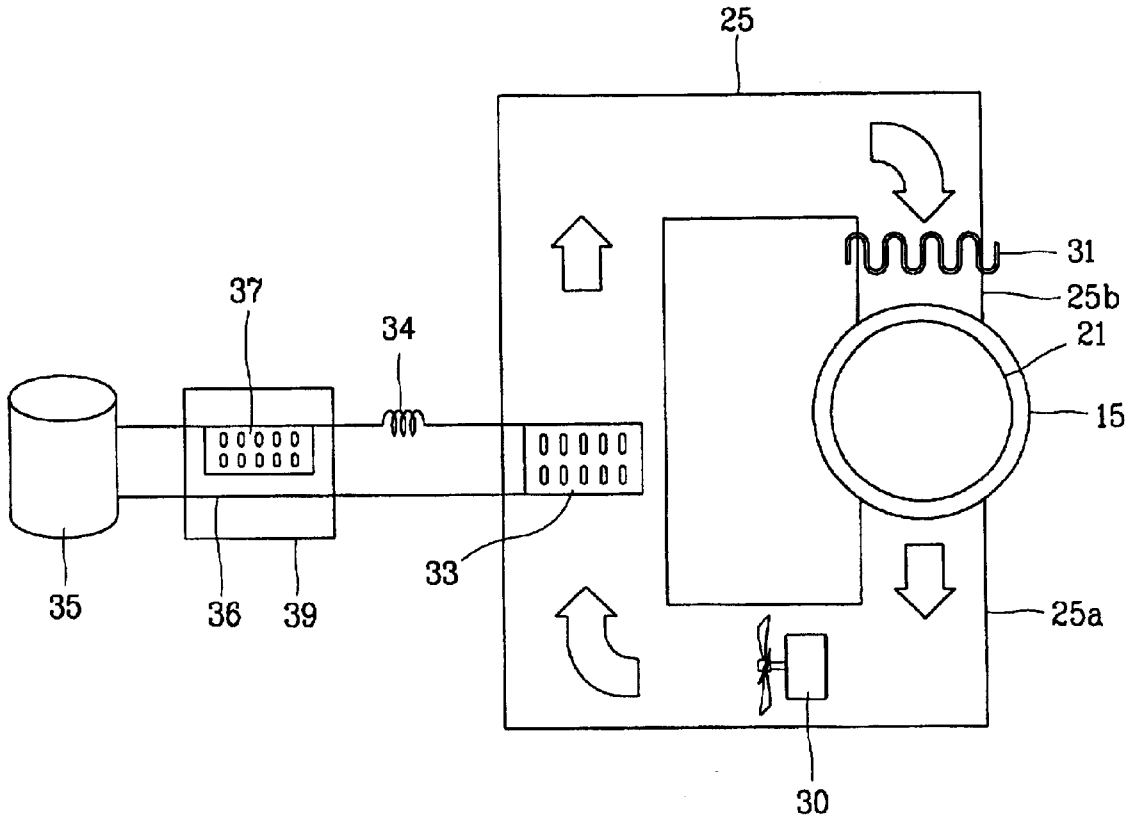
FIG. 4 is a schematic view showing the structure of air in the washing and drying machine of FIG. 3.

First, an embodiment of the present invention will be described with reference to FIGS. 3 and 4. FIG. 3 is a longitudinal sectional view showing a clothes washing and drying machine in accordance with an embodiment of the present invention and FIG. 4 is a schematic view showing the structure of air in the washing and drying machine of FIG. 3.

With reference to FIG. 3, the upper surface of the case 11 is opened so that clothes which will be washed or dried are inputted or outputted and a door 13 for opening and closing the case 11 is installed at the opened portion.

An outer tub 15 supported by supporting rods, formed in the shape of a cylinder with the upper portion opened and filled with washing water inside is installed in the case 11 and a closing door 16 for closing the inner portion of the outer tub 15 is installed at the opened upper portion.

Inside the outer tub 15, an inner tub 21 formed in the shape of a basket with the upper portion opened, to which washing material which will be washed or dried is inputted and washed is installed rotatably.

In the inner tub 21, a pulsator 23 for forming a flow of washing water in washing clothes is rotatably installed related to the inner tub 21.

A driving motor 17 is installed on the bottom surface of the outer tub 15 to rotate and drive the inner tub 21 and the pulsator 23 and a drain hose 19 for discharging washing water extends and is connected into the outside of the case 11 at one side of the bottom surface of the outer tub 15.

A water cooling tank 39 is installed at the center portion of the drain hose 11 to store the washing water discharged to the outside and a close/open valve 40 is installed at the drain hose 19*c* at the lower flow side of the water cooling tank 39.

An air circulating duct 25 extends and is connected from the lower side to the upper side of the outer tub 15 is installed to supply heated air into the inner tub 21 circulating the air. The inlet portion 25*a* of the air circulating duct 25 is connected to the drain hose and the outlet potion 25*b* is connected to the upper end portion of the outer tub 15, thus to re-circulate the air which dried clothes in the inner tub 21.

A directional control valve is positioned at the position where the air circulating duct 25 is diverged from the drain hose 19 to open or close the flowing passage and switch the direction.

The directional control valve 29 can be formed as a three-way-valve and the valve can block the drain hose 19*a* of upper flow side not to discharge washing water in operating washing and rinsing clothes. In the washing water supply mode, the valve opens only the side of the drain hose 19 to discharge washing water in the outer tub 15 through the drain hose 19 and in the clothes drying mode, the valve opens only the side of the air circulating duct 25 to re-circulate the air discharged from the outer tub 15 to the air circulating duct.

At the side of the suction portion 25*a* of the air circulating duct 25, a blower 30 is positioned to accelerate a flow of air and a heater 31 is positioned at the discharge portion 25*b* to heat the air.

Particularly, an evaporator 33 is installed in the air circulating duct 25 to remove moisture contained in the air which dried the clothes at the front of the heater 31 to the air flowing direction. A tray 26 having a drain port is installed at the lower end portion of the air circulating duct 25 to discharge condensed water falling from the evaporator 33 and a water pipe 27 is connected from the tray 26 to the outside of the case.

A compressor 35, condenser 37 and capillary tube 34 are installed in the case 11. Here, the compressor 35 compresses refrigerant sucked from the evaporator 33 and the condenser 37 condenses the refrigerant compressed in the compressor 35. The capillary tube 34 changes the refrigerant condensed between the condenser 37 and the evaporator 33 into having low pressure.

Particularly, the condenser 37 is cooled by the water cooling method and installed in the water cooling tank 39 so that it can be cooled by the washing water discharged through the drain hose 19.

Also, a part of a refrigerating line 36 through which refrigerant is sucked from the evaporator to the compressor 35 passes through the inside of the water cooling tank 39 so that the portion can be cooled by cooling water.

On the other hand, a water level control device is positioned to supply washing water storing a proper amount and methods of using a sensor or an overflow tube are used for the water level control means.

In the method of using a sensor, a water level sensor (not shown) is installed at the upper portion of the water cooling tank 39 and when water is stored more than a certain amount, the open/close valve 40 is opened by a signal inputted to the control unit (not shown). When water is stored less than the amount, the open/close valve 40 is closed.

As shown in FIG. 3, by the method using the overflow tube 39*a*, an overflow tube 39*a* is connected to the upper portion of the water cooling tank 39 and when the washing water is stored more than a certain amount under the condition that the open/close valve 40 is closed, the excess washing water overflows to the outside. On the other hand, the water pipe 27 can be connected to the water cooling tank 39.

The operation of the washing and drying machine in accordance with an embodiment of the present invention will be described as follows. The washing and rinsing operations are performed rotating the pulsator 23 and the inner tub 21 by operating the driving motor 17 under the condition that the drain hose 19*a* is closed by the direction control valve 29 to wash clothes.

After performing the washing and rinsing operation, the direction control valve 29 is operated and the washing water is supplied by closing the side of the air circulating duct 25 and opening the side of the drain hose 19 to perform draining and dewatering operation.

At this time, a proper amount of washing water for cooling the condenser by the overflow tube 39*a* or the water level sensor is stored in the water cooling tank 39 and the rest is discharged.

When the supplying and dewatering operation of the washing water is completed, clothes drying operation is performed by controlling the direction control valve 29 closing the side of the drain hose 19 and opening the side of the air circulating duct 25.

At this time, when the blower 30, heater 31 and the compressor 35 are operated simultaneously, heated air is flown into the inner tub 21 by the operation of the blower 30 and the air with high temperature and humidity which dried clothes in the inner tub 21 is flown into the air circulating duct 25 through the drain hose 19*a*.

The air with high temperature and humidity flown into the air circulating duct 25 passes through the evaporator 33. At this time, moisture contained in the air is condensed being contacted with the evaporator 33 having relatively lower temperature and the dehumidified air passed the evaporator 33 is heated passing through the heater 31 and supplied into the inner tub 21, thus to dry the clothes.

Here, the moisture dehumidified in the evaporator 33 is discharged to the outside through water pipe 27 connected to the lower side of the air circulating duct 25

Figure 5:
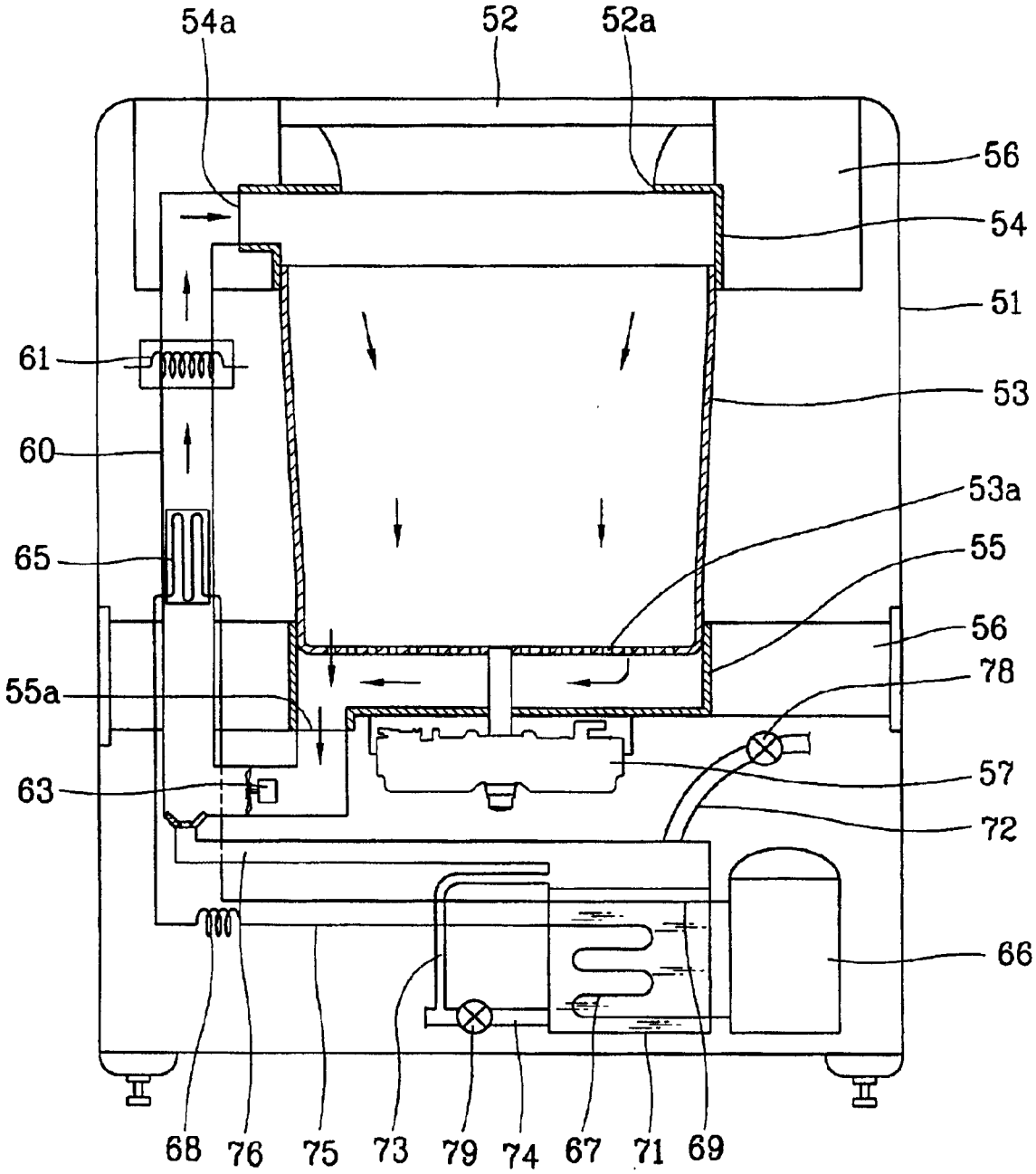
FIG. 5 is a longitudinal sectional view showing a clothes washing and drying machine in accordance with another embodiment of the present invention.

FIG. 5 is a longitudinal sectional view showing a clothes washing and drying machine in accordance with another embodiment of the present invention. As shown in FIG. 5, a clothes dryer in accordance with the present invention has a drum 53 having a cylindrical structure in the case 51 to dry clothes. The upper portion of the drum 53 is formed opened to input or output clothes and a plurality of discharge ports 53*a* are formed on the lower surface.

The upper portion of the drum 53 is combined with an upper cover 54 and the lower portion is combined with a lower cover 55. The upper cover and the lower cover 55 is fixed by a fixing member 56 fixed in the case 51 and supports the drum 53 to rotate.

The case 51 and the upper cover 54 is formed in an opened structure so that clothes can be inputted into the drum 53 and outputted from the drum 53. A door 52 is installed in the case 51 and a gasket member 53*a* for closing the opened portion of the upper cover 54 is installed at the door 52.

A driving motor 57 for rotating the drum 53 is installed at the lower side of the lower cover 55 and the shaft of the driving motor 57 is connected to the drum 53 through the lower cover 55. An air circulating duct for drying clothes inputted to the drum 53 circulating heated air into the drum 53 is positioned in the lower cover 55 and the upper cover 54.

Namely, a discharge port 55*a* is formed in the lower cover 55 and a suction port 54*a* is formed in the upper cover 54. The both end portions of the air circulating duct 60 is connected to the discharge port 55*a* and the suction port 54*a* respectively.

A blower 63 for compulsorily circulating air in the drum 53 and a heater 61 for heating circulating air are installed on the air circulating duct 60. Also, an evaporator 65 for dehumidifying the air which dried clothes in the drum 53 is installed on the air circulating duct 60.

The evaporator 65 is included in a refrigerating cycle circuit connected to the compressor 66, condenser 67 and capillary tube 68 positioned in the case 51. The condenser 67 is positioned in the water cooling tank 71 to cool by the water cooling method. The upper side of the water cooling tank 71 is connected with the water supply hose 72 for supplying cooling water and the lower side is connected with the water discharge hose 74 for discharging cooling water. Open/close valves 78 and 79 are installed in the water supply hose 72 and the water discharge hose 74.

Also, an overflow tube 73 connected with the discharge hose 74 is positioned in the water cooling tank 71 to discharge water when more than a certain amount of water is stored. The water cooling tank 71 can be composed to maintain a proper water level by adjusting the opened or closed condition of the open/close valves 78 and 79 by installing a water level sensor in the water cooling tank 71.

A tray 75 and water pipe 76 are positioned at the lower end portion of the air circulating duct 60 to discharge condensed water discharged from the evaporator 65 in the drum 53 and it is desirable that the water pipe 76 is connected to the water cooling tank 71. As a part of a refrigerating line 69 sucked from the evaporator 65 to the compressor 66 passes through the water cooling tank 71 to exchange heat with cooling water.

The performance of the clothes dryer in accordance with the other embodiment of the present invention will be described as follows. When the blower 63, heater 61 and compressor 66 are operated after inputting wet clothes which were dewatered by a washing machine, air heated by the heater 61 is supplied into the drum 53 and the heated air dries the clothes being contacted to the clothes. The air becomes to have high temperature and humidity and flows into the air circulating duct 60 through the discharge port 55*a* of the lower cover 55.

The air with high temperature and humidity which flows into the air circulating duct 60 is contacted with the evaporator 65 and condensed on the surface of the evaporator 65. The air which passed through the evaporator 65 is heated by the heater 61 and supplied into the drum 53 under the state of high temperature and low humidity. Drying of clothes is performed repeating the above process. On the other hand, the condensed water fallen from the surface of the evaporator 65 is collected by the tray 75 and flown into the water cooling tank 71 through the water pipe 76.

In the embodiments described and shown above, examples of the washing and drying machine and clothes dryer having an inner tub or drum which is rotatably positioned centering around the rotation shaft positioned along the vertical direction of the case are described but the present invention can be applied to examples of the washing and drying machine and clothes dryer having a rotation shaft which is tilted a certain angle to the horizontal or vertical direction of the case.

Also, in the embodiments described and shown above, examples of the washing and drying machine and clothes dryer having a heating device composed of an electric heater are described but the present invention can be applied to the washing and drying machine and clothes dryer having a gas burner as the heating means.

Since the washing and drying machine and clothes dryer in accordance with the present invention is composed to dry clothes by heating under the condition that the air is dehumidified using the refrigerating cycle, time for drying clothes can be shortened by improving the dehumidifying performance and energy consumption can be reduced.

Since the washing and drying machine and clothes dryer in accordance with the present invention is composed to dry clothes by the water cooling method, the present invention can improve dehumidifying efficiency and increase efficiency of the refrigerating cycle related to the air cooling method at the same time. Therefore, the design of the whole refrigerating cycle device can be composed more compactly.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A washing and drying machine, comprising:

an outer tub supported in a case in which washing water is capable of being stored;

a drain hose connected from a lower side of the outer tub to the outside of the case for draining washing water;

an inner tub capable of receiving clothes to be washed and dried and being installed rotatably in the outer tub;

a driving motor installed at the lower side of the outer tub for rotating the inner tub;

an air circulating duct connected from a first side of the outer tub to a second side of the outer tub, wherein air for drying the clothes in the inner tub is circulated by said air circulating duct;

a blower installed in the air circulating duct for circulating the air;

heater installed in the air circulating duct for heating the circulating air;

a dehumidification device for dehumidifying air circulated into the air circulating duct using a refrigerating cycle, wherein said dehumidification device includes a compressor, a condenser, a capillary tube and an evaporator which form a refrigerating cycle circuit; and a water cooling tank for storing washing water discharged from the outer tub, wherein the evaporator is installed in the air circulating duct and the condenser is installed at a center portion of the drain hose to cool water by a water cooling method in the water cooling tank.

2. The machine according to claim 1, further comprising:

an opened upper surface for each of the case, outer tub and the inner tub, respectively; and means for closing an inner portion of the outer tub installed at the opened upper portion of the outer tub, wherein the inner tub is rotatably centered around a rotation shaft positioned with respect to a vertical direction of the case.

3. The machine according to claim 1, wherein the air duct diverges from the drain hose, and further comprising valve means for switching an opening and closing direction, and a flowing direction, wherein said valve means is installed at a position where the drain hose and the air duct diverge.

4. The machine according to claim 1, wherein the dehumidification device is positioned at a side of the heater in the air flowing direction.

5. The machine according to claim 1, wherein the blower, the dehumidification device and the heater are consecutively installed in the air flowing direction in the air circulating duct.

6. The machine according to claim 1, wherein a water pipe is connected to the lower portion of the air circulating duct to discharge dehumidified water.

7. The machine according to claim 1, wherein a part of a refrigerant line for connecting the evaporator and condenser is cooled passing through the drain hose.

8. The machine according to claim 1, further comprising:

a valve installed in the drain hose connected to the lower side of the cooling water tank, and water level control means installed in the water cooling tank for maintaining a certain water level.

9. The machine according to claim 8, wherein said water level control means further includes an overflow tube connected to an upper portion of the cooling water tank.

* * * * *